US010139197B1

(12) United States Patent
Horton et al.

(10) Patent No.: US 10,139,197 B1
(45) Date of Patent: Nov. 27, 2018

(54) FIREARM SIGHT WITH RETRACTABLE SUNSHADE

(71) Applicant: Sellmark Corporation, Mansfield, TX (US)

(72) Inventors: Jonathan Horton, Arlington, TX (US); Tianliang Chen, Chengdu (CN); Andrew Pischke, Mansfield, TX (US)

(73) Assignee: Sellmark Corporation, Mansfield, TX (US)

( * ) Notice: Subject to any disclaimer, the term of this patent is extended or adjusted under 35 U.S.C. 154(b) by 0 days.

(21) Appl. No.: 15/647,632

(22) Filed: Jul. 12, 2017

(51) Int. Cl.

| | |
|---|---|
| ***F41G 1/30*** | (2006.01) |
| ***F41G 1/38*** | (2006.01) |
| ***F41G 1/06*** | (2006.01) |
| *F41G 1/04* | (2006.01) |

(52) U.S. Cl.
CPC ..... *F41G 1/30* (2013.01); *F41G 1/065* (2013.01); *F41G 1/383* (2013.01); *F41G 1/04* (2013.01)

(58) Field of Classification Search
CPC ... F41G 1/04; F41G 1/065; F41G 1/30; F41G 1/383
See application file for complete search history.

(56) References Cited

U.S. PATENT DOCUMENTS

| | | | | |
|---|---|---|---|---|
| 737,872 | A | 9/1903 | Saegmuller | |
| 1,380,810 | A | 6/1921 | Robert | |
| 1,796,456 | A | 3/1931 | Halldorson | |
| 1,943,387 | A | 1/1934 | Karl | |
| 2,271,380 | A | 1/1942 | Martin et al. | |
| 2,466,786 | A | 4/1949 | Dallas | |
| 2,633,051 | A | 3/1953 | Davis | |
| 2,657,465 | A | 11/1953 | Lloyd | |
| 2,889,629 | A * | 6/1959 | Darkenwald | F41G 1/383 359/511 |
| 2,968,099 | A | 1/1961 | Peters | |
| 2,972,190 | A * | 2/1961 | Vissing | F41G 1/383 359/511 |
| 3,208,146 | A | 9/1965 | Nelson | |
| 3,390,931 | A | 7/1968 | Luning et al. | |
| 3,465,446 | A | 9/1969 | Cox | |
| 3,496,642 | A | 2/1970 | Pfahler | |
| 3,641,894 | A | 2/1972 | Conner | |

(Continued)

FOREIGN PATENT DOCUMENTS

CN 102798318 B 9/2014

OTHER PUBLICATIONS

"How to Use Fieldscopes / Nomenclature", Nikon, imaging.nikon.com, 2018.*

(Continued)

*Primary Examiner* — Troy Chambers
*Assistant Examiner* — Joshua T Semick
(74) *Attorney, Agent, or Firm* — Mark D. Perdue

(57) ABSTRACT

A firearm sight comprises a sight body including a clamp at its lower extent for removably securing the sight to a portion of a firearm. An upwardly facing surface is disposed on the sight body above the clamp and a housing projects above the upwardly facing portion, the housing containing a lens assembly. A shade is carried by the sight body, the shade movable along the sight body from a retracted position in which the shell is at least partially contained by the housing, and an extended position in which the shell extends over the upwardly facing surface.

18 Claims, 3 Drawing Sheets

(56) References Cited

U.S. PATENT DOCUMENTS

| | | | | |
|---|---|---|---|---|
| 3,746,423 | A | 7/1973 | Mills | |
| 3,831,285 | A | 8/1974 | Vissing | |
| 3,840,883 | A | 10/1974 | Choate | |
| 3,977,113 | A | 8/1976 | Howell | |
| 4,089,117 | A | 5/1978 | Villarreal | |
| 4,205,895 | A | 6/1980 | Yurdin et al. | |
| 4,444,465 | A | 4/1984 | Giulie et al. | |
| 4,569,572 | A | 2/1986 | Kopich | |
| 4,734,989 | A | 4/1988 | Sanders | |
| 4,815,822 | A | 3/1989 | Bramhall | |
| 4,926,560 | A | 5/1990 | Kilgore et al. | |
| 5,155,915 | A | 10/1992 | Repa | |
| 5,181,140 | A | 1/1993 | Brown et al. | |
| 5,183,953 | A | 2/1993 | Anderson et al. | |
| 5,201,135 | A | 4/1993 | Cowles | |
| 5,369,888 | A | 12/1994 | Kay et al. | |
| 5,506,727 | A | 4/1996 | Douglas et al. | |
| 5,508,843 | A * | 4/1996 | Tomita | F41G 1/38 356/252 |
| 5,631,772 | A | 5/1997 | Mizukawa | |
| 5,813,159 | A | 9/1998 | Kay et al. | |
| D445,475 | S | 7/2001 | Spear | |
| 6,488,381 | B2 | 12/2002 | Morgan | |
| 7,234,265 | B1 | 6/2007 | Cheng et al. | |
| 7,484,856 | B1 * | 2/2009 | Newhall | F41G 1/04 359/511 |
| 7,647,721 | B1 | 1/2010 | Gaber et al. | |
| 8,024,885 | B1 * | 9/2011 | Newhall | F41G 1/04 359/511 |
| 8,087,196 | B2 | 1/2012 | Jung et al. | |
| 8,181,379 | B2 | 5/2012 | Brewer | |
| 9,046,320 | B2 * | 6/2015 | Keng | F41G 11/003 |
| 9,470,470 | B2 | 10/2016 | Pisani et al. | |
| 9,696,114 | B1 * | 7/2017 | Cabrera | F41G 1/17 |
| 9,816,780 | B1 * | 11/2017 | Stefanick | F41G 1/383 |
| 9,823,044 | B1 * | 11/2017 | Cabrera | F41G 1/17 |
| 2007/0091474 | A1 | 4/2007 | Hubbard | |
| 2011/0141571 | A1 | 6/2011 | Allen | |
| 2011/0314720 | A1 | 12/2011 | Cheng | |

OTHER PUBLICATIONS

"Tactical Red Dot riflescope Reflex Sight Fit Shotguns Rib Rail Hunting", www.aliexpress.com, 2018.*

"William Watson No. 32 MK 1 1943", guntrader.com, 2018.*

Hillman, Bruce, Optics for the shooters, Shooting Industry 36, p. 24 (Apr. 1991) (8 pages retrieved from Dialog ProQuest).

* cited by examiner

FIREARM SIGHT WITH RETRACTABLE SUNSHADE

BACKGROUND OF THE INVENTION

1. Field of the Invention

The invention relates to firearm sights and more particularly to reflex or reflector sights.

2. Summary of the Prior Art

Conventional reflector or reflex sights generally comprise a front lens designed to reflect the aiming dot through an open optical path. This design of reflector sights, compared to the similar "red dot" sight, helps achieve a smaller, more compact design. The design of a red dot sight, although typically larger in size, utilizes a closed (enclosed) optical path which provides better environmental protection and reduction in lens glare and reflections.

The lack of environmental protection from rain, dust, and lens glare is a shortcoming of reflector sights. In bright lighting conditions, it is common for the top surface of a reflector sight to be a visible reflection when looking through the lens of the sight. This optical interference can cause inaccurate aiming or visual interference for the user.

Some reflector sights are provided with an additional housing designed to house and protect the unit's lens from cracking when dropped. These housings do not extend the whole length of the sight. Aftermarket accessories have been produced that can attach a "sunshade" or cover over the open optical path to or from the lens(es) of a reflex sight. These devices, however, typically cannot be installed quickly (in a matter of seconds), causing the shooter to lose sense of their environment. Also, current covers are installed with a press fit or snap-on connection. Current attachment methods allow the cover to easily fall off and get lost in the field. They also cannot be easily stored due to their bulky designs so if removed in the field they must be uncomfortably stored in the user's pocket or in a bag.

Finally, current covers are designed to be installed and remain on the sight at all times; however, use of a sunshade creates a "tunnel vision" effect which obstructs the user's field of view and impairs their situational awareness. Therefore, there remains the need to quickly and selectively use a reflector sight cover or shade.

SUMMARY OF THE INVENTION

It is a general object of the present invention to provide an improved sight for firearms. This and other objects of the present invention are achieved by providing a sight body including a clamp at its lower extent for removably securing the sight to a portion of a firearm. An upwardly facing surface is disposed on the sight body above the clamp and a housing projects above the upwardly facing portion, the housing containing a lens assembly. A shade is carried by the sight body, the shade movable along the sight body from a retracted position in which the shell is at least partially contained by the housing, and an extended position in which the shell extends over the upwardly facing surface.

A groove may be formed on each side of the sight body below the upwardly facing surface, wherein a corresponding portion of the shade engages and slides in each groove.

A ball detent may be located between the shade and the housing, the ball detent engaging with a recess in the shade to temporarily secure the shell against movement relative to the housing.

The upwardly facing surface may be disposed rearward of the housing when the sight is mounted on a firearm.

In the retracted position, the shade may be generally coextensive with the housing.

Other objects, features, and advantages of the present invention will become apparent with reference to the figures and the detailed description, which follow.

DETAILED DESCRIPTION OF THE INVENTION

Figure 1A:
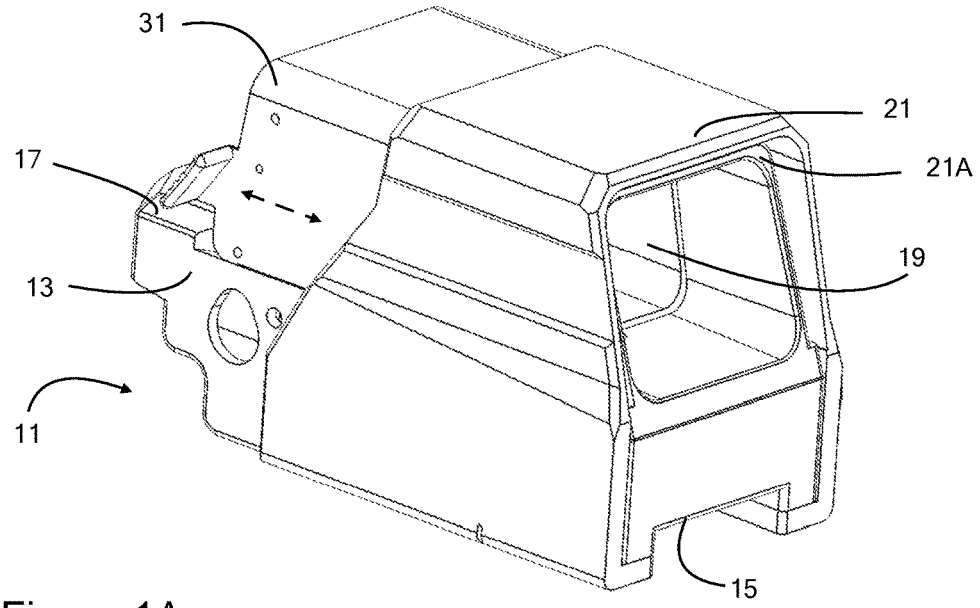
FIGS. 1A and 1B are perspective views of the sight of an embodiment of the present invention illustrating the shade or shell portion in extended or deployed and retracted positions.
Figure 1B:
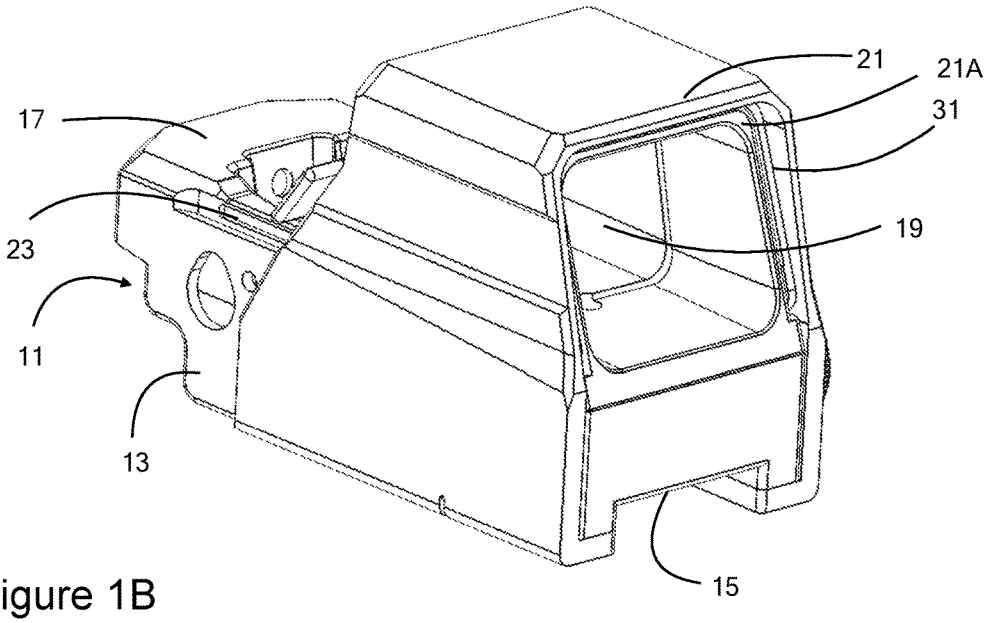
Figure 2:
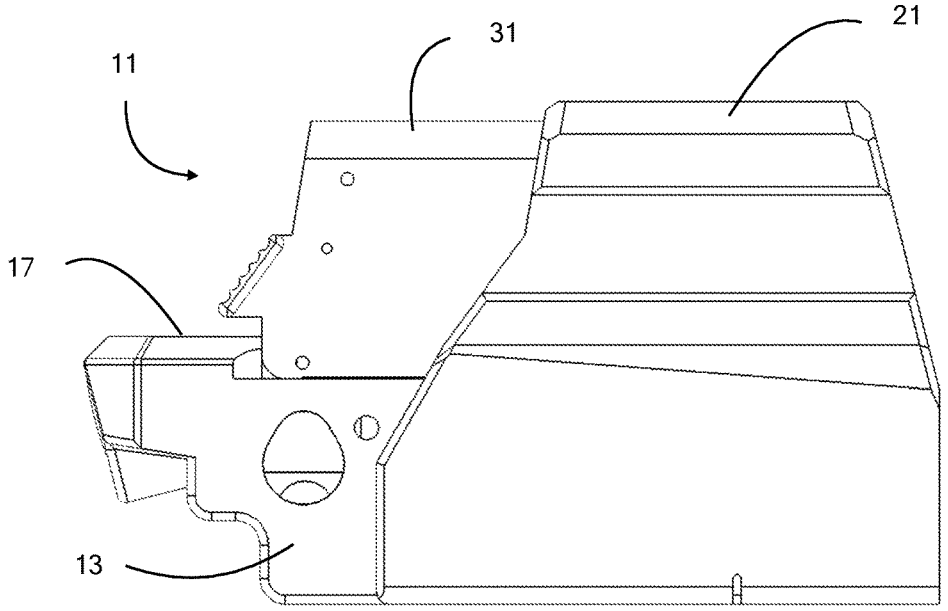
FIG. 2 is a side elevation view of the sight of FIGS. 1A and 1B.

Referring now to the Figures, and in particular to FIGS. 1A, 1B, and 2, a firearm sight 11 according to one embodiment of the present invention is illustrated. Sight 11 is preferably of the reflex or reflector type and comprises a sight body 13, which has a clamp 15 at its lower extent for attachment to a mounting rail (11 mm or 0.375 inch dovetail or Picatinny or Weaver rail) on a firearm. Sight 11 is secured or attached to a rail on the receiver or barrel of a firearm in alignment with the bore of the weapon to provide a means of precisely aiming at targets.

At an upper extent of sight body 13, parallel to and generally opposite clamp 15, are a generally flat, upwardly facing surface 17 and a lens assembly 19 contained or housed in a housing 21. Housing 21 projects above surface 17. As can be seen in FIG. 1A, surface 17 is not truly flat, but multi-level and contains recesses for various aspects of sight 11, thus it is described as "generally flat."

In a preferred embodiment of the invention, a collimated light source or laser is contained in sight body 13 and a collimated light beam is projected upward (from within or below surface 17) to lens assembly 19, which is partially reflective and permits a user to see the image (a dot or other reticle) of the collimated light beam superimposed on the optical image from light gathered by lens assembly 19. The dot or other reticle then is used to aim the firearm at a target. These aspects of sight 11 are conventional. Similarly configured sights, of whatever operating principle, are contemplated by the present invention. Telescopic and "red dot" sights, with optics and other elements housed and enclosed, along with the optical path, in a tube, are not because they do not present the problems associated with more "open" sight designs, such as the illustrated reflector or reflex, non-magnifying type sights.

In the illustrated embodiment, flat surface 17 extends rearwardly (toward the user), behind housing 21 and lens assembly 19. The collimated light beam is thus projected on lens assembly 19 from the rear. In other embodiments, flat surface 17 may extend forward (toward the muzzle of the firearm rather than toward the user) of housing 21 and lens assembly 19, in which case the collimated light beam is projected from the front of lens assembly 19. An optical or light path to or from lens assembly 19 is defined above flat surface 17 and extends to the uppermost extent of lens assembly 19.

As shown in FIGS. 1A and 1B, a sun shade or hood 31 is slidably mounted on sight body 13 and is movable between an extended or deployed position (FIG. 1A) and a retracted or stored position (FIG. 1B). In the deployed or extended position, shade or hood 31 extends from housing 21 and 13 covers the optical path over surface 17 and reduces lens glare and offers some protection to lens assembly 19. In the stored or retracted position, shade or hood 31 is generally coextensive with housing 21, which is covered by a cosmetic shell that actually contains and overlies retracted hood 31. Thus, in the retracted or stored position, shade or hood 31 may be contained in a recess in housing 21 (such as that defined between the cosmetic shell and sight body 13), or simply overlie housing 21. In either case, by being generally coextensive (the same size and shape, with generally similar, if slightly larger or smaller dimensions) with housing 21, hood or shade 31 does not disrupt the external contours of sight 11 in the retracted or stored position.

Figure 3:
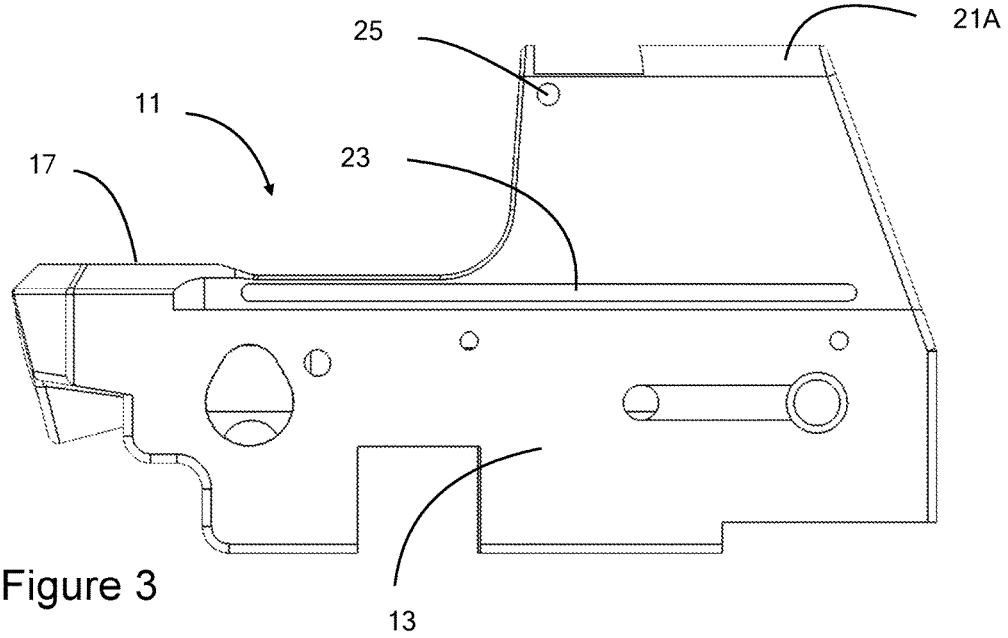
FIG. 3 is a side elevation view similar to that of FIG. 2 with a shell removed.

FIG. 3 depicts sight body 13 with the cosmetic shell removed to reveal the inner, structural housing 21A of sight body 13 that actually houses the lens assembly 19. The cosmetic shell covers apertures in sight body 13 and generally presents a smooth appearance to the exterior of sight 11, but is not necessary to its operation. A pair of longitudinally extending grooves 23 may be formed in each side of sight body 13 aligned with and just below surface 17 to receive corresponding bosses or protrusions on shade or shell 31 (see FIGS. 4 and 5). A spring-loaded or biased ball plunger or detent 25 may be located on each side of housing portion 21A of sight body 13 to engage recesses (see FIG. 5) in shade 31 to temporarily restrain or secure shade or hood 31 in the deployed or stored positions. The position of detents (and corresponding recesses) and length of grooves 23 govern how far shade or hood 31 travels between the stored and deployed positions.

Figure 4:
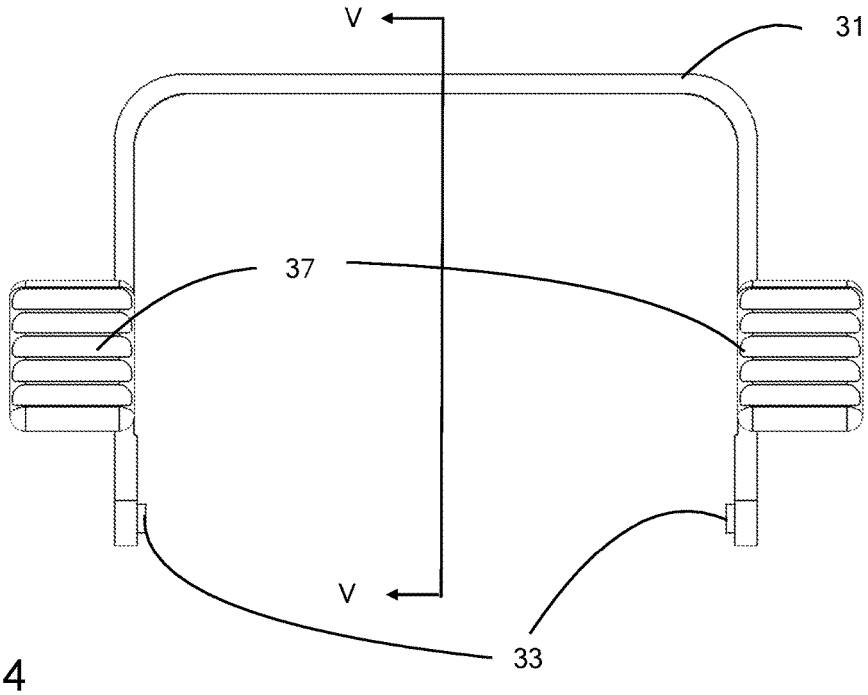
FIG. 4 is an end elevation view of the shade or shell.
Figure 5:
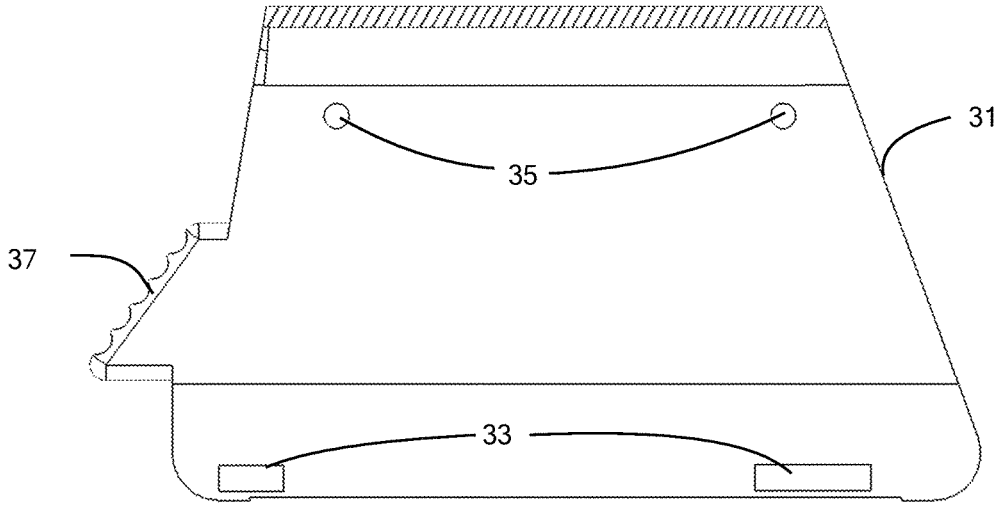
FIG. 5 is a side section view, taken along section line V-V of FIG. 4, of the shade or shell portion.

FIGS. 4 and 5 depict shade or hood 31. Shade 31 may be formed of relatively rigid polymeric or metallic material and is generally U-shaped in cross-section, as shown. Shell 31 may include four projections or bosses 33, arranged in pairs on each side, which register with and slide in grooves 23 in the sides of sight body 13. Four apertures or recesses 35 (a forward and rearward pair on each side of shade 31) may be provided to receive and register with ball detents 25 on the housing portion 21A of sight body 31 to secure shade 31 temporarily in the deployed and stored positions as depicted in FIGS. 1A and 1B. A pair of knurled or textured tabs 37 may be provided on each side of shade 31 to provide purchase or grip for the user's fingers in moving shade between the deployed and stored positions.

In operation, the user may maintain shade or hood 31 in either the deployed or stored positions. If the user encounters conditions favoring or requiring a shade over the optical path (extremely bright or directional light), the user may deploy shade 31 by sliding it into the extended or deployed position until the corresponding detents 25, 35 engage (as shown in FIG. 1A). Upon encountering conditions unfavorable to use of a shade (dim light or a combat-type situation requiring maximum situational awareness), the user may retract shade 31 into the retracted or stored position, where detents 25, 35 maintain it until its deployment is required or desired again. Shade 31 thus remains integral with sight 11 and is always available for use.

The invention has been described with reference to preferred and illustrative embodiments thereof. It is thus not limited, but is susceptible to variation and modification without departing from the scope and spirit of the invention.

We claim:

1. A sight for a firearm comprising:

a sight body including a clamp at a lower extent for removably securing the sight to a portion of a firearm;

an upwardly facing surface on the sight body above the clamp;

a housing on the sight body and projecting above the upwardly facing portion, the housing containing a lens assembly;

a shade carried by the sight body, the shade movable along the sight body from a retracted position in which the shade is at least partially contained by the housing, and an extended position in which the shade extends over the upwardly facing surface; and a sliding attachment between a lower extent of the shade and the sight body proximal the upwardly facing, generally flat surface, wherein the shade is retained on the sight body in the extended position.

2. The sight of claim 1, wherein the sliding attachment further comprises:

a groove formed on each side of the sight body below the upwardly facing surface, wherein a corresponding portion of the shade engages and slides in each groove.

3. The sight of claim 1, further comprising a ball detent between the shade and the housing, the ball detent engaging with a recess in the shade to temporarily secure the shade against movement relative to the housing.

4. The sight of claim 1, wherein the upwardly facing surface is disposed rearward of the housing when the sight is mounted on a firearm.

5. The sight of claim 1, wherein, in the retracted position, the shade is generally coextensive with the housing.

6. A sight for a firearm comprising:

a sight body, including a clamp at a lower extent for securing the sight to a firearm;

an upwardly facing, generally flat surface on the sight body above and generally parallel with the clamp;

a housing containing a lens assembly, the housing projecting upwardly from the flat surface;

a shade slidably received in the housing, the shade movable from a stored position in which the shade is generally coextensive with the housing, and a deployed position in which the shade extends from the housing over at least a portion of the flat surface; and a sliding attachment between a lower extent of the shade and the sight body proximal the upwardly facing, generally flat surface, wherein the shade is retained on the sight body in the extended position.

7. The sight of claim 6, wherein the sliding attachment further comprises:

a longitudinally extending groove on each side of the sight body below and generally parallel to the flat surface;

a pair of projections carried by the shade, each projection received in one of the grooves in the sight body to slidably secure the shade to the sight body.

8. The sight of claim 6, further comprising:

at least one detent between the sight body and the shade to secure the shade in one of the deployed and stored positions.

9. The sight of claim 6, wherein the flat surface is disposed rearward of the housing when the sight is mounted on a firearm.

10. The sight of claim 6, wherein, in the stored position, the shade is generally coextensive with the housing.

11. A firearm sight comprising:

a sight body, including a clamp at a lower extent for securing the sight to a firearm;

an upwardly facing surface on the sight body above and generally parallel with the clamp;

a housing containing a lens assembly, the housing projecting upwardly from the flat surface;

a pair of grooves formed in the sight body on opposing sides thereof, below and generally parallel to the upwardly facing surface;

a shade slidably mounted on the sight body and retained thereon by engagement between portions of the shade and the grooves in the sight body, the shade slidable from a retracted position in which the shade is generally coextensive with the housing, and a deployed position in which the shade extends from the housing over the flat surface and is retained on the sight body; and at least one detent between the shade and the sight body, the detent configured to temporarily secure the shade in one of the retracted and deployed positions.

12. The sight of claim 11, wherein the flat surface is disposed rearward of the housing when the sight is mounted on a firearm.

13. The sight of claim 1, wherein the sight is a reflector sight.

14. The sight of claim 6, wherein the sight is a reflector sight.

15. The sight of claim 11, wherein the sight is a reflector sight.

16. The sight of claim 1, further comprising:

a light source in the sight body; and an optical path defined between the light source and the lens assembly, wherein, in the extended position, the shade covers the optical path.

17. The sight of claim 6, further comprising:

a light source in the sight body; and an optical path defined between the light source and the lens assembly, wherein, in the deployed position, the shade covers the optical path.

18. The sight of claim 11, further comprising:

a light source in the sight body; and an optical path defined between the light source and the lens assembly, wherein, in the deployed position, the shade covers the optical path.

* * * * *